US011254889B2

(12) United States Patent
Sato

(10) Patent No.: US 11,254,889 B2
(45) Date of Patent: Feb. 22, 2022

(54) MINERAL OIL TYPE BASE OIL, AND VACUUM PUMP OIL

(71) Applicant: IDEMITSU KOSAN CO., LTD., Chiyoda-ku (JP)

(72) Inventor: Tokue Sato, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/489,743

(22) PCT Filed: Mar. 9, 2018

(86) PCT No.: PCT/JP2018/009160

§ 371 (c)(1),
(2) Date: Aug. 29, 2019

(87) PCT Pub. No.: WO2018/164258

PCT Pub. Date: Sep. 13, 2018

(65) Prior Publication Data

US 2020/0231890 A1 Jul. 23, 2020

(30) Foreign Application Priority Data

Mar. 10, 2017 (JP) ..... JP2017-046669

(51) Int. Cl.

| | |
|---|---|
| ***C10M 101/02*** | (2006.01) |
| ***C10N 40/00*** | (2006.01) |
| ***C10N 20/00*** | (2006.01) |
| ***C10N 20/02*** | (2006.01) |
| ***C10N 30/10*** | (2006.01) |

(52) U.S. Cl.

CPC .. *C10M 101/02* (2013.01); *C10M 2203/1006* (2013.01); *C10M 2203/1025* (2013.01); *C10M 2205/0285* (2013.01); *C10N 2020/015* (2020.05); *C10N 2020/02* (2013.01); *C10N 2030/10* (2013.01); *C10N 2040/44* (2020.05)

(58) Field of Classification Search

CPC ..... C10M 101/02; C10M 171/00; C10M 2203/1006; C10M 2203/1025; C10M 2205/0285; C10M 2207/026; C10M 2215/064; C10M 2215/065; C10M 2215/223; C10N 2040/44; C10N 2020/015; C10N 2020/017; C10N 2020/02; C10N 2020/093; C10N 2030/10

See application file for complete search history.

(56) References Cited

U.S. PATENT DOCUMENTS

| | | | | |
|---|---|---|---|---|
| 6,066,604 | A | 5/2000 | Kaneko | |
| 2006/0287203 | A1* | 12/2006 | Ito | C10M 141/08 508/362 |
| 2010/0016195 | A1 | 1/2010 | Shirahama et al. | |
| 2010/0035777 | A1 | 2/2010 | Sano et al. | |
| 2010/0041572 | A1 | 2/2010 | Sano et al. | |
| 2010/0093568 | A1 | 4/2010 | Tagawa et al. | |
| 2011/0218131 | A1* | 9/2011 | Tsujimoto | C10M 169/041 508/382 |
| 2011/0237477 | A1* | 9/2011 | Tagawa | B01J 29/068 508/469 |

FOREIGN PATENT DOCUMENTS

| | | | | |
|---|---|---|---|---|
| CN | 104995285 | A | 10/2015 | |
| JP | 7-166184 | A | 6/1995 | |
| JP | 11-131081 | A | 5/1999 | |
| JP | 2002-317190 | A | 10/2002 | |
| JP | 2014-129461 | A | 7/2014 | |
| JP | 2014-214258 | A | 11/2014 | |
| WO | WO 2006/073198 | A1 | 7/2006 | |
| WO | WO 2007/105769 | A1 | 9/2007 | |
| WO | WO 2007/114132 | A1 | 10/2007 | |
| WO | WO 2008/004548 | A1 | 1/2008 | |
| WO | WO 2010/041689 | A1 | 4/2010 | |
| WO | WO 2010/041692 | A1 | 4/2010 | |
| WO | WO-2014174106 | A1 * | 10/2014 | C10M 169/04 |

OTHER PUBLICATIONS

International Search Report dated May 1, 2018 in PCT/JP2018/009160 filed on Mar. 9, 2018.

Notice of Reasons for Refusal dated Jan. 26, 2021 in Japanese Patent Application No. 2017-046669 (with English language translation), 11 pages.

Office Action in CN Application No. 201880016567.4 (w/Translation), dated Aug. 13, 2021, 27 pages.

Feng Gang et al., "Development and application of the series products of mechanical vacuum pump oil", Lubricating Oil, vol. 23, No. 1, pp. 32-36, Feb. 28, 2008 Sponsor: PetroChina Lubricant Company, PetroChina Lubricating Oil Information Station of Science and Technology Editor & Publisher: Editorial Office of Lubricating Oil Printer: Dalian Dongsheng Printing Co., Ltd. Distributor(Domestic): Dalian Post Office.

Office Action in JP Application No. 2017-046669 (w/Translation), dated Aug. 31, 2021, 12 pages.

* cited by examiner

*Primary Examiner* — James C Goloboy

(74) *Attorney, Agent, or Firm* — Oblon, McClelland, Maier & Neustadt, L.L.P.

(57) ABSTRACT

Provided is a mineral base oil that conforms to viscosity grades VG22 to VG100 as defined in ISO 3448 and exhibits a distillation curve with a temperature gradient Δ|DT| of distillation temperature between two points of 2.0 vol % and 5.0 vol % of distillation amount being 6.8° C./vol % or less. A vacuum pump oil containing the mineral base oil is excellent in vacuum characteristics and can conform to viscosity grades VG22 to VG100 as defined in ISO 3448.

19 Claims, No Drawings

MINERAL OIL TYPE BASE OIL, AND VACUUM PUMP OIL

TECHNICAL FIELD

The present invention relates to a mineral base oil and a vacuum pump oil containing the mineral base oil.

BACKGROUND ART

Vacuum technology is widely used in the fields of semiconductors, solar cells, aircraft, automobiles, and the like, as well as in vacuum pack processing and retort processing in the food production process.

As a vacuum pump used for performing the vacuum technology corresponding to these fields, for example, mechanical vacuum pumps such as a reciprocating vacuum pump and a rotary vacuum pump, or high vacuum pumps such as an oil rotary vacuum pump and an oil diffusion vacuum pump are selected according to the use.

In recent years, with the broadening of the fields of application of the vacuum pump, a vacuum pump oil used in the vacuum pump is required not only to improve vacuum characteristics but also to improve properties such as thermal stability and oxidation stability according to the use of the vacuum pump.

For example, PTL 1 discloses, as an object of providing a lubricating oil composition excellent in oxidation resistance and ozone resistance and suitable as a vacuum pump oil, a lubricating oil composition obtained by blending at least one antioxidant which is any one of a phenol-based antioxidant, an amine-based antioxidant, a sulfur-based antioxidant and a phosphorus-based antioxidant, which is easily soluble in a base oil, and which does not crystallize under an operating condition of a vacuum pump, with a mineral lubricating base oil and/or a synthetic lubricating base oil.

CITATION LIST

Patent Literature

PTL 1: JP 7-166184 A

SUMMARY OF INVENTION

Technical Problem

Typically, as a base oil contained in a vacuum pump oil, a mineral oil is often selected from the viewpoint of a cost. However, the mineral oil contains a light component that cannot be removed even in a purification step. The light component causes deterioration of the vacuum characteristics, such as an increase in the obtained ultimate vacuum pressure of the vacuum pump.

On the other hand, in order to reduce the influence of the light component, it is also conceivable to use a mineral oil having a high distillation temperature and a high viscosity. However, it is difficult to adjust such a high viscosity mineral oil to, for example, a vacuum pump oil conforming to VG46 standard or VG68 standard as defined in ISO 3448. In addition, even when such a high viscosity mineral oil is used, the vacuum characteristics of the vacuum pump may be deteriorated.

Therefore, there is a need for a mineral oil that is excellent in vacuum characteristics and is applicable for preparing a vacuum pump oil conforming to VG46 standard or VGG8 standard as defined in ISO 3448.

With respect to such a matter, in PTL 1, no investigation is made on a relationship between the mineral oil used as a base oil and the vacuum characteristics.

The present invention has been made in view of the above matters, and an object thereof is to provide a mineral base oil that is excellent in vacuum characteristics and is applicable for easily preparing a vacuum pump oil conforming to viscosity grades VG22 to VG100 as defined in ISO 3448, and a vacuum pump oil containing the mineral base oil.

Solution to Problem

The present inventor has found that the above problems can be solved with a mineral base oil that is prepared to conform to viscosity grades VG22 to VG100 as defined in ISO 3448, and to exhibit a distillation curve with a temperature gradient of distillation temperature between two points of 2.0 vol % and 5.0 vol % of distillation amount being a predetermined value or less.

Specifically, the present invention provides the following [1] and [2]. [1] A mineral base oil, which conforms to viscosity grades VG22 to VG100 as defined in ISO 3448, and exhibits a distillation curve with a temperature gradient $\Delta|DT|$ of distillation temperature between two points of 2.0 vol % and 5.0 vol % of distillation amount being 6.8° C./vol % or less. [2] A vacuum pump oil containing the mineral base oil according to [2].

Advantageous Effects of Invention

The mineral base oil of the present invention is excellent in vacuum characteristics and is applicable for easily preparing a vacuum pump oil conforming to viscosity grades VG22 to VG100 as defined in ISO 3448.

DESCRIPTION OF EMBODIMENTS

In the present specification, the values of kinematic viscosity at 40° C. and viscosity index are values measured or calculated in conformity with JIS K2283.

[Mineral Base Oil]

A mineral base oil of the present invention satisfies the following requirements (1) and (2).

Requirement (1): the mineral base oil conforms to viscosity grades VG22 to VG100 as defined in ISO 3448

Requirement (2): the mineral base oil exhibits a distillation curve with a temperature gradient $\Delta|DT|$ of distillation temperature between two points of 2.0 vol % and 5.0 vol % of distillation amount (hereinafter, simply referred to as "temperature gradient $\Delta|DT|$") being 6.8° C./vol % or less.

Since the mineral base oil of the present invention is a vacuum pump oil prepared to conform to VG 22 to VG 100 as defined in the requirement (1) and further to satisfy the requirement (2), it is possible to easily prepare a vacuum pump oil having a desired viscosity with improved vacuum characteristics as compared with a mineral oil in the related art.

As described above, the general mineral oil that conforms to VG22 to VG100 contains a light component that cannot be removed even in a purification step, and the presence of the light component causes deterioration of the vacuum characteristics such as an increase in an ultimate vacuum pressure.

Therefore, a degassing process is usually performed to remove the light component, but performing such a process has a large cost burden.

In addition, even in the mineral oil subjected to the degassing process, the light component is not removed, and the vacuum characteristics of the vacuum pump oil may also be deteriorated.

On the other hand, with regard to the vacuum characteristics of the vacuum pump oil, even when some light components are present, the deterioration of the vacuum characteristics due to the light component can be prevented depending on the structure and molecular weight of a wax component in the mineral oil.

That is, in the vacuum pump oil that conforms to VG22 to VG100, in order to improve the vacuum characteristics, it is necessary to consider not only the light component contained in the mineral oil, but also the structure of the wax component in the mineral oil.

That is, the temperature gradient defined in the requirement (2) is a parameter considering a relationship between the state of the mineral oil such as a content of the light component and the structure of the wax component and the vacuum characteristics when the mineral oil is used as the vacuum pump oil.

In the distillation curve of the mineral oil, the behavior of the distillation curve varies around an initial boiling point where the distillation amount is less than 2 vol %, and it is difficult to accurately evaluate the state of the mineral oil.

In addition, when the distillation amount is 10 vol % to 20 vol %, the variation of the distillation curve is stabilized, but a distillation point reaches a temperature at which the light component is discharged, making the state of the mineral oil not accurately evaluated.

In contrast, the present inventor has focused on the temperature gradient Δ|DT| of distillation temperature between two points of 2.0 vol % and 5.0 vol % of distillation amount in the distillation curve of the mineral base oil, as defined in the requirement (2).

Since the distillate amount of 2.0 vol % to 5.0 vol % is a temperature region where the variation of the distillation curve is stabilized and the light component also remains, the state of the light component and the wax component of the mineral base oil can be accurately evaluated.

According to the investigation of the present inventor, it is found that the mineral base oil that is prepared to exhibit a distillation curve with a temperature gradient Δ|DT| of a distillation temperature between two points of 2.0 vol % and 5.0 vol % of distillation amount being 6.8° C./vol % or less as defined in the requirement (2) is applicable for preparing a vacuum pump oil that is excellent in vacuum characteristics as compared with a mineral oil in the related art.

It is considered that the mineral base oil satisfying the requirement (2) exhibits such effects because the light component which affects the vacuum characteristics is reduced in the mineral base oil, and even when some light component is contained in the mineral base oil, an adverse influence of the light component on the vacuum characteristics is prevented depending on the wax component in the mineral base oil.

It is also found that the mineral base oil satisfying the requirement (2) can effectively prevent a decrease in water separation property due to blending of an antioxidant such as a phenol-based compound or an amine-based compound.

Therefore, even when the mineral base oil of the present invention further contains an antioxidant, a good water separation property can be maintained and a vacuum pump oil having further improved oxidation stability can be produced.

From the viewpoint of producing a mineral base oil applicable for preparing a vacuum pump oil having excellent vacuum characteristics and a good water separation property, the temperature gradient Δ|DT| defined in the requirement (2) of the mineral base oil according to one embodiment of the present invention is preferably 6.5° C./vol % or less, more preferably 6.3° C./vol % or less, still more preferably 6.0° C./vol % or less, and yet still more preferably 5.0° C./vol % or less.

The temperature gradient Δ|DT| defined in the requirement (2) is usually 0.1° C./vol % or more.

In the present specification, the temperature gradient Δ|DT| defined in the requirement (2) means a value calculated from the following formula.

Temperature gradient Δ|DT| (° C./vol %)=|[distillation temperature (° C.) at which distillation amount of mineral base oil is 5.0 vol %]|[distillation temperature (° C.) at which distillation amount of mineral base oil is 2.0 vol %]|/3.0 (vol %)

The "distillation temperature (° C.) at which distillation amount of mineral base oil is 5.0 vol % or 2.0 vol %" in the above formula is a value measured by a method in conformity with ASTM D6352, specifically means a value measured by a method described in Examples.

From the viewpoint of producing a mineral base oil applicable for preparing a vacuum pump oil having excellent vacuum characteristics and a good water separation property, the distillation temperature at which the distillation amount of the mineral base oil according to one embodiment of the present invention is 2.0 vol % is preferably 405° C. to 510° C., more preferably 410° C. to 500° C., still more preferably 415° C. to 490° C., and yet still more preferably 430° C. to 480° C.

In addition, from the viewpoint of producing a mineral base oil applicable for preparing a vacuum pump oil having excellent vacuum characteristics and a good water separation property, the distillation temperature at which the distillation amount of the mineral base oil according to one embodiment of the present invention is 5.0 vol % is preferably 425° C. to 550° C., more preferably 430° C. to 520° C., still more preferably 434° C. to 500° C., and yet still more preferably 450° C. to 490° C.

Examples of the mineral base oil of the present invention include an atmospheric residue obtained by atmospheric distillation of a crude oil, such as a paraffinic crude oil, an intermediate crude oil, and a naphthenic crude oil; a distillate oil obtained by vacuum distillation of the atmospheric residue; a mineral oil obtained by subjecting the distillate oil to at least one purification process, such as solvent deasphalting, solvent extraction, hydrofinishing, solvent dewaxing, catalytic dewaxing, isomerization dewaxing, and vacuum distillation; and a mineral oil (GTL) obtained by isomerizing a wax (GTL wax (Gas To Liquids WAX)) produced from natural gas by a Fischer-Tropsch method.

These mineral base oils may be used either alone or in combination of two or more thereof.

Among these, the mineral base oil according to one embodiment of the present invention is preferably a paraffinic mineral oil.

The paraffin content (% $C_P$) of the mineral base oil according to one embodiment of the present invention is usually 50 or more, preferably 55 or more, more preferably 60 or more, still more preferably 65 or more, yet more preferably 70 or more, and is usually 99 or less.

In the present specification, the paraffin content (% $C_P$) means a value measured in conformity with ASTM D-3238 ring analysis (n-d-M method).

The mineral base oil satisfying the requirement (2) can be prepared by appropriately considering the following matters.

The following matters merely represent an example of the preparation method, and it is also possible to prepare the mineral base oil by considering matters other than the following matters.

- The number of stages of a distillation column and a flux flow rate when distilling a feedstock oil are appropriately adjusted.
- The feedstock oil is distilled at a distillation temperature at which the 5 vol % fraction of the distillation curve is 425° C. or higher, and a fraction having a viscosity grade ranging from VG22 to VG100 is collected.
- Preferably, the feedstock oil is subjected to a purification process including a hydrogenation isomerization dewaxing step, and more preferably, the feedstock oil is subjected to a purification process including a hydrogenation isomerization dewaxing step and a hydrofinishing step.
- A supply proportion of the hydrogen gas in the hydrogenation isomerization dewaxing step is preferably 200 $Nm^3$ to 500 $Nm^3$, more preferably 250 $Nm^3$ to 450 $Nm^3$, and still more preferably 300 $Nm^3$ to 400 $Nm^3$ per kiloliter of the feedstock oil to be supplied.
- A hydrogen partial pressure in the hydrogenation isomerization dewaxing step is preferably 5 MPa to 25 MPa, more preferably 7 MPa to 20 MPa, and still more preferably 10 MPa to 15 MPa.
- A liquid hourly space velocity (LHSV) in the hydrogenation isomerization dewaxing step is preferably 0.2 $hr^{-1}$ to 2.0 $hr^{-1}$, more preferably 0.3 $hr^{-1}$ to 1.5 $hr^{-1}$, and still more preferably 0.5 $hr^{-1}$ to 1.0 $hr^{-1}$.
- A reaction temperature in the hydrogenation isomerization dewaxing step is preferably 250° C. to 450° C., more preferably 270° C. to 400° C., and still more preferably 300° C. to 350° C.

A kinematic viscosity at 40° C. of the mineral base oil according to one embodiment of the present invention is preferably 19.8 $mm^2/s$ to 110 $mm^2/s$, more preferably 28.8 $mm^2/s$ to 90.0 $mm^2/s$, still more preferably 35.0 $mm^2/s$ to 80.0 $mm^2/s$, and yet still more preferably 41.4 $mm^2/s$ to 74.8 $mm^2/s$.

A viscosity index of the mineral base oil according to one embodiment of the present invention is preferably 80 or more, more preferably 90 or more, still more preferably 100 or more, and yet still more preferably 110 or more, and further preferably less than 160, more preferably 155 or less, still more preferably 150 or less, and yet still more preferably 145 or less.

[Vacuum Pump Oil]

The vacuum pump oil of the present invention contains the mineral base oil (I) according to the present invention.

However, the vacuum pump oil according to one embodiment of the present invention may also contain a base oil (II) other than the mineral base oil (I) according to the present invention in order to adjust the viscosity of the vacuum pump oil within a range not impairing the effects of the present invention.

That is, examples of the vacuum pump according to the present invention include the following two embodiments.

- A vacuum pump oil containing only the mineral base oil (I) according to the present invention as a base oil.
- A vacuum pump oil containing the mineral base oil (I) according to the present invention and another base oil (II) as a base oil.

The vacuum pump oil according to one embodiment of the present invention may contain a general additive blended with a general vacuum pump oil within a range not impairing the effects of the present invention, and preferably contains an antioxidant.

The mineral base oil (I) of the present invention can maintain a good water separation property even when a general additive such as an antioxidant is blended, and the function of the blended general additive can be effectively exhibited.

In the vacuum pump oil according to one embodiment of the present invention, the content of the mineral base oil (I) of the present invention is preferably 50% by mass or more, more preferably 60% by mass or more, still more preferably 65% by mass or more, and yet still more preferably 70% by mass or more based on the total amount (100% by mass) of the vacuum pump oil.

When the content of the mineral base oil (I) is 50% by mass or more, a vacuum pump oil having excellent vacuum characteristics and a good water separation property can be produced.

<Another Base Oil (II)>

Examples of another base oil (II) that may be used in the vacuum pump oil according to one embodiment of the present invention include a mineral oil and a synthetic oil other than the mineral base oil (I) of the present invention.

Another mineral oil (II) may be used either alone or in combination of two or more thereof.

In the vacuum pump oil according to one embodiment of the present invention, the content of another base oil (II) is preferably less than 50% by mass, more preferably 0 to 40% by mass, still more preferably 0 to 35% by mass, and yet still more preferably 0 to 30% by mass based on the total amount (100% by mass) of the vacuum pump oil.

Examples of the mineral oil that may be selected as another base oil (II) include an atmospheric residue obtained by atmospheric distillation of a crude oil, such as a paraffinic crude oil, an intermediate crude oil, and a naphthenic crude oil; a distillate oil obtained by vacuum distillation of the atmospheric residue; a mineral oil obtained by subjecting the distillate oil to at least one purification process, such as solvent deasphalting, solvent extraction, hydrofinishing, solvent dewaxing, catalytic dewaxing, isomerization dewaxing, and vacuum distillation; and a mineral oil (GTL) obtained by isomerizing a wax (GTL wax (Gas To Liquids WAX)) produced from natural gas by a Fischer-Tropsch method.

Among these, a mineral oil classified into Group 2 or 3 in API (American Petroleum Institute) category is preferred, and a mineral oil classified into Group 3 is more preferred.

In the present specification, the mineral oil classified into another base oil (II) means a mineral base oil not satisfying the requirements (1) and/or (2), and is distinguished from the mineral base oil (I) in this point.

Examples of the synthetic oil that may be selected as another base oil (II) include a poly-α-olefin (PAO), an ester-based compound, an ether-based compound, a polyalkylene glycol, an alkylbenzene, and an alkylnaphthalene.

Among these, a poly-α-olefin (PAO) is preferred.

The vacuum pump oil according to one embodiment of the present invention may contain, as well as the mineral base oil (I), a mineral oil (II-1) having a viscosity grade not lower than a viscosity grade of VG220 as defined in ISO 3448, as another mineral oil (II). That is, a kinematic viscosity at 40° C. of the mineral oil (II-1) is 194 $mm^2/s$ or more.

By blending the mineral oil (II-1) having a high viscosity, it is easy to prepare a vacuum pump oil having a desired kinematic viscosity. This also contributes to improvement of oxidation stability of the vacuum pump oil.

Further, since the mineral oil (II-1) is a mineral oil having a high viscosity, the distillation temperature is high and the content of the light component is small. Therefore, the mineral oil (II-1) alone is not suitable for preparation of the vacuum pump oil, but by containing the mineral oil (II-1) together with the mineral base oil (I) of the present invention, a vacuum pump oil having a desired kinematic viscosity and excellent in vacuum characteristics can be obtained at a low cost.

Since the mineral oil (II-1) does not satisfy at least the requirement (1), the mineral oil (II-1) is distinguished from the mineral base oil of the present invention in this point, but it does not matter whether the requirement (2) is satisfied or not.

When the vacuum pump oil according to one embodiment of the present invention contains the mineral base oil (I) and the mineral oil (II-1), from the above viewpoints, the content ratio of the mineral base oil (I) to the mineral oil (II-1) [(I)/(II-1)] is preferably 50/50 to 99/1, more preferably 55/45 to 95/5, still more preferably 60/40 to 90/10, and yet still more preferably 65/35 to 85/15 in terms of mass ratio.

The mineral oil (II-1) is preferably a paraffinic mineral oil.

The mineral oil (II-1) is preferably a mineral oil classified into Group 2 or 3 in API (American Petroleum Institute) category, and more preferably a mineral oil classified into Group 3.

<Antioxidant>

From the viewpoint of further improving oxidation stability, the vacuum pump oil according to one embodiment of the present invention preferably further contains an antioxidant.

The antioxidant may be used either alone or in combination of two or more thereof.

Typically, a vacuum pump oil obtained by blending an antioxidant such as a phenol-based compound or an amine-based compound with a general mineral oil is inferior in water separation property.

In contrast, since the vacuum pump of the present invention contains the mineral base oil (I) as a base oil, the degree of decrease in water separation property due to blending of the antioxidant can be prevented and the water separation property can be maintained well.

Therefore, the vacuum pump oil according to one embodiment of the present invention can maintain a good water separation property even when the antioxidant is contained, and can further improve the oxidation stability by the addition of the antioxidant.

From the viewpoint of producing a vacuum pump oil having good oxidation stability and water separation property, in the vacuum pump oil according to one embodiment of the present invention, the content of the antioxidant is preferably 0.01% by mass to 15% by mass, more preferably from 0.05% by mass to 10% by mass, still more preferably 0.10% by mass to 5% by mass, and yet still more preferably 0.15% by mass to 2% by mass based on the total amount (100% by mass) of the vacuum pump oil.

From the viewpoint of further improving the oxidation stability, in the vacuum pump oil according to one embodiment of the present invention, the antioxidant preferably contains one or more selected from a phenol-based antioxidant and an amine-based antioxidant, and more preferably contains both a phenol-based antioxidant and an amine-based antioxidant.

In the vacuum pump oil according to one embodiment of the present invention, the content ratio of the phenol-based antioxidant to the amine-based antioxidant [phenol-based antioxidant/amine-based antioxidant] is preferably 1/4 to 6/1, more preferably 1/3 to 5/1, and still more preferably 1/2 to 4/1 in terms of mass ratio.

(Phenol-Based Antioxidant)

The phenol-based antioxidant used in the present invention may be a compound having an antioxidant property and having a phenol structure, and may be a monocyclic phenol-based compound or a polycyclic phenol-based compound.

The phenol-based antioxidant may be used either alone or in combination of two or more thereof.

Examples of the monocyclic phenol-based compound include 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl) phenol, 2,6-di-t-amyl-4-methylphenol, and benzenepropanoic acid 3,5-bis (1,1-dimethylethyl)-4-hydroxyalkyl ester.

Examples of the polycyclic phenol-based compound include 4,4'-methylenebis(2,6-di-t-butylphenol), 4,4'-isopropylidenebis(2,6-di-t-butylphenol), 2,2'-methylenebis(4-methyl-6-t-butylphenol), 4,4'-bis(2,6-di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

In the vacuum pump oil according to one embodiment of the present invention, the phenol-based antioxidant is preferably a hindered phenol compound having at least one structure represented by the following formula (b-1) in one molecule, and more preferably benzenepropanoic acid 3,5-bis (1,1-dimethylethyl)-4-hydroxyalkyl ester and 4,4'-methylenebis(2,6-di-t-butylphenonol).

(b-1)

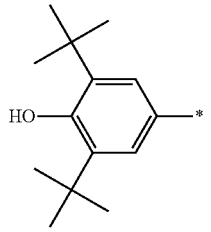

(In the above formula (b-1), * represents the bonding position.)

In one embodiment of the present invention, from the viewpoint of producing a vacuum pump oil having excellent vacuum characteristics, the molecular weight of the phenol-based antioxidant is preferably 100 to 1000, more preferably 150 to 900, still more preferably 200 to 800, and yet still more preferably 250 to 700.

(Amine-Based Antioxidant)

The amine-based antioxidant used in one embodiment of the present invention may be an amino compound having an antioxidant property. From the viewpoint of producing a vacuum pump oil having improved oxidation stability, the amine-based antioxidant is preferably an aromatic amine compound, and more preferably one or more selected from a diphenylamine compound and a naphthylamine compound.

The amine-based antioxidant may be used either alone or in combination of two or more thereof.

Examples of the diphenylamine compound include a monoalkyl diphenylamine compound having one alkyl group having 1 to 30 (preferably 4 to 30, more preferably 8 to 30) carbon atoms such as monooctyl diphenylamine and monononyl diphenylamine; a dialkyldiphenylamine compound having two alkyl groups each having 1 to 30 (preferably 4 to 30, more preferably 8 to 30) carbon atoms such as 4,4'-dibutyldiphenylamine, 4,4'-dipentyldiphenylamine, 4,4'-dihexyldiphenylamine, 4,4'-diheptyldiphenylamine, 4,4'-dioctykliphenylamine, and 4,4'-dinonykliphenylamine; a polyalkyldiphenylamine compound having three or more alkyl groups each having 1 to 30 (preferably 4 to 30, more preferably 8 to 30) carbon atoms such as tetrabutyl diphenylamine, tetrahexyl diphenylamine, tetraoctyl diphenylamine, and tetranonyl diphenylamine; and 4,4'-bis(α,α-dimethylbenzyl) diphenylamine.

Examples of the naphthylamine compound include 1-naphthylamine, phenyl-1-naphthylamine, butylphenyl-1-naphthylamine, pentylphenyl-1-naphthylamine, hexylphenyl-1-naphthylamine, heptylphenyl-1-naphthylamine, octylphenyl-1-naphthylamine, nonylphenyl-1-naphthylamine, decylphenyl-1-naphthylamine, and dodecylphenyl-1-naphthylamine.

In the vacuum pump oil according to one embodiment of the present invention, the amine-based antioxidant preferably contains at least a diphenylamine compound, and more preferably a dialkyldiphenylamine compound having two alkyl groups each having 1 to 30 (preferably 1 to 20, more preferably 1 to 10) carbon atoms.

In one embodiment of the present invention, from the viewpoint of producing a vacuum pump oil having excellent vacuum characteristics, the molecular weight of the amine-based antioxidant is preferably 100 to 1000, more preferably 150 to 900, still more preferably 200 to 800, and yet still more preferably 250 to 700.

<General Additive>

The vacuum pump oil according to one embodiment of the present invention may contain, as necessary, a general additive other than the antioxidant within a range not impairing the effects of the present invention.

Examples of such a general additive include a metal deactivator and an antifoaming agent.

These general additives may be used either alone or in combination of two or more thereof.

The content of each general additive may be appropriately adjusted according to the type of the general additive within a range not impairing the effects of the present invention.

In the vacuum pump oil according to one embodiment of the present invention, the total content of the general additives is preferably 0 to 30% by mass, more preferably 0 to 20% by mass, still more preferably 0 to 10% by mass, and yet still more preferably 0 to 3% by mass based on the total amount (100% by mass) of the vacuum pump oil.

<Various Properties of Vacuum Pump Oil>

The vacuum pump oil according to one embodiment of the present invention preferably conforms to viscosity grades VG22 to VG100 as defined in ISO 3448.

A vacuum pump oil having a viscosity grade ranging from VG22 to VG100 may exhibit excellent vacuum characteristics.

The kinematic viscosity at 40° C. of the vacuum pump oil according to one embodiment of the present invention is preferably 19.8 $mm^2/s$ to 110 $mm^2/s$, more preferably 28.8 $mm^2/s$ to 90.0 $mm^2/s$, still more preferably 35.0 $mm^2/s$ to 80.0 $mm^2/s$, and yet still more preferably 41.4 $mm^2/s$ to 74.8 $mm^2/s$.

Among these, in one embodiment of the present invention, a vacuum pump oil that conforms to a viscosity grade VG46 as defined in ISO 3448 is preferred.

The kinematic viscosity at 40° C. of the vacuum pump oil that conforms to VG46 is preferably 41.4 $mm^2/s$ to 50.6 $mm^2/s$, more preferably 42.0 $mm^2/s$ to 50.0 $mm^2/s$, and still more preferably 43.0 $mm^2/s$ to 49.5 $mm^2/s$.

Further, in one embodiment of the present invention, a vacuum pump oil that conforms to a viscosity grade VG68 as defined in ISO 3448 is preferred.

The kinematic viscosity at 40° C. of the vacuum pump oil that conforms to VG68 is preferably 61.2 $mm^2/s$ to 74.8 $mm^2/s$, more preferably 63.0 $mm^2/s$ to 72.0 $mm^2/s$, and still more preferably 65.0 $mm^2/s$ to 70.0 $mm^2/s$.

The viscosity index of the vacuum pump oil according to one embodiment of the present invention is preferably 80 or more, more preferably 90 or more, still more preferably 100 or more, yet still more preferably 110 or more and is preferably less than 160, more preferably 155 or less, still more preferably 150 or less, and yet still more preferably 145 or less.

The RPVOT value of the vacuum pump oil according to one embodiment of the present invention is preferably 200 minutes or longer, more preferably 220 minutes or longer, and still more preferably 240 minutes or longer.

In the present specification, the RPVOT value of the vacuum pump oil is a value measured under conditions described in Examples to be described later in conformity with a rotary pressure vessel oxidation test (RPVOT) of JIS K2514-3.

The acid value increase amount of the vacuum pump oil before and after the rotary pressure vessel oxidation test (RPVOT) is preferably 0.10 mgKOH/g or less, more preferably 0.05 mgKOH/g or less, and still more preferably 0.01 mgKOH/g or less.

When a water separation test at a temperature of 54° C. is performed on the vacuum pump oil according to one embodiment of the present invention in conformity with JIS K2520, the degree of emulsification indicating the time for an emulsified layer to reach 3 mL is preferably shorter than 20 minutes, more preferably 15 minutes or shorter, still more preferably 10 minutes or shorter, and yet still more preferably 5 minutes or shorter.

The ultimate vacuum pressure of the vacuum pump oil according to one embodiment of the present invention measured in conformity with JIS B8316-2 is preferably 0.6 Pa or less, more preferably 0.5 Pa or less, and still more preferably 0.4 Pa or less.

[Use of Vacuum Pump Oil]

The vacuum pump oil according to the present invention is excellent in vacuum characteristics, comforts to viscosity grades VG22 to VG100 as defined in ISO 3448, and may be applied to various uses.

The use of the vacuum pump oil according to the present invention is not particularly limited, and it is suitable as a lubricating oil for a vacuum pump, which is used, for example, in the production of a semiconductor, a solar cell, an aircraft or an automobile, or in the production of food at least including vacuum pack processing or retort processing.

The vacuum pump is not particularly limited, and examples of the vacuum pump include an oil rotary vacuum pump, a mechanical booster pump, a dry pump, a diaphragm vacuum pump, a turbo molecular pump, an ejector (vacuum) pump, an oil diffusion pump, a sorption pump, a titanium supplementation pump, a sputter ion pump, a cryo pump, a swinging piston type dry vacuum pump, a rotary blade type dry vacuum pump, and a scroll type dry vacuum pump.

That is, the present invention may also provide a method of using the following [1].

[1] A method of use of a vacuum pump oil, including using the vacuum pump oil according to the present invention in a vacuum pump to be used in production of a semiconductor, a solar cell, an aircraft or an automobile, or in production of food at least including vacuum pack processing or retort processing.

EXAMPLES

Next, the present invention is hereunder described in more detail by reference to Examples, but it should be construed that the present invention is by no means limited to the following Examples. Measurement methods of various physical properties are as follows.

(1) Kinematic viscosity at 40° C. and viscosity index

The kinematic viscosity at 40° C. and viscosity index were measured or calculated in conformity with JIS K2283.

(2) Distillation temperature at which the distillation amount is 2.0 vol % and 5.0 vol %

The distillation temperature was measured by distillation gas chromatography in conformity with ASTM D6352.

(3) Paraffin content (% $C_p$)

The paraffin content was measured in conformity with ASTM D-3238 ring analysis (n-d-M method).

(4) Density at 15° C.

The density was measured in conformity with JIS K2249.

Production Example 1 (Preparation of Mineral Base Oil (1))

A feedstock oil, which was a fraction oil of 200 neutral or more, was subjected to a hydrogenation isomerization dewaxing process, then subjected to a hydrofinishing process, and was thereafter distillated at a distillation temperature at which a 5 vol % fraction of a distillation curve was 460° C. or higher, and fractions having a kinematic viscosity at 40° C. ranging from 19.8 $mm^2/s$ to 50.6 $mm^2/s$ were collected, so as to prepare a mineral base oil (1).

Conditions for the hydrogenation isomerization dewaxing process are as follows.

Hydrogen gas supply proportion: 300 $Nm^3$ to 400 $Nm^3$ per kiloliter of feedstock oil to be supplied.

Hydrogen partial pressure: 10 MPa to 15 MPa.

Liquid hourly space velocity (LHSV): 0.5 $hr^{-1}$ to 1.0 $hr^{-1}$.

Reaction temperature: 300° C. to 350° C.

Production Example 2 (Preparation of Mineral Base Oil (2))

A mineral base oil (2) was prepared in the same method as in Production Example 1 except that a paraffinic mineral oil was used, the paraffinic mineral oil was distillated at a distillation temperature at which the 5 vol % fraction of the distillation curve was 430° C. or higher, and fractions having a kinematic viscosity at 40° C. ranging from 61.2 $mm^2/s$ to 110 $mm^2/s$ were collected.

Production Example 3 (Preparation of Mineral Base Oil (3))

A mineral base oil (3) was prepared in the same method as in Production Example 1 except that a paraffinic mineral oil was used, the paraffinic mineral oil was distillated at a distillation temperature at which the 5 vol % fraction of the distillation curve was 400° C. or higher, and fractions having a kinematic viscosity at 40° C. ranging from 19.8 $mm^2/s$ to 50.6 $mm^2/s$ were collected.

Production Example 4 (Preparation of Mineral Base Oil (4))

A mineral base oil (4) was prepared in the same method as in Production Example 1 except that a paraffinic mineral oil was used, the paraffinic mineral oil was distillated at a distillation temperature at which the 5 vol % fraction of the distillation curve was 420° C. or higher, and fractions having a kinematic viscosity at 40° C. ranging from 61.2 $mm^2/s$ to 110 $mm^2/s$ were collected.

Production Example 5 (Preparation of Mineral Base Oil (5))

A mineral base oil (5) was prepared in the same method as in Production Example 1 except that a paraffinic mineral oil was used, the paraffinic mineral oil was distillated at a distillation temperature at which the 5 vol % fraction of the distillation curve was 500° C. or higher, and fractions having a kinematic viscosity at 40° C. ranging from 194 $mm^2/s$ to 506 $mm^2/s$ were collected.

With respect to the mineral base oils (1) to (5) obtained in Production Examples 1 to 5, the distillation temperatures at which the distillate amount was 2.0 vol % and 5.0 vol % were measured, a temperature gradient Δ|Dt| was calculated, and the kinematic viscosity at 40° C., the viscosity index, and the paraffin content (% $C_p$) were measured. The results are shown in Table 1.

TABLE 1

| Mineral base oil | | Production Example 1 (1) | Production Example 2 (2) | Production Example 3 (3) | Production Example 4 (4) | Production Example 5 (5) |
|---|---|---|---|---|---|---|
| Distillation temperature at distillation amount of 2.0 vol % | ° C. | 451.0 | 415.0 | 383.1 | 400.3 | 468.0 |
| Distillation temperature at distillation amount of 5.0 vol % | ° C. | 464.0 | 434.0 | 404.0 | 422.3 | 505.0 |
| Temperature gradient Δ\|Dt\| | ° C./vol % | 4.3 | 6.3 | 7.0 | 7.3 | 12.3 |
| Kinematic viscosity at 40° C. | $mm^2/s$ | 43.75 | 99.27 | 34.96 | 75.23 | 408.8 |
| Viscosity index | — | 143 | 102 | 119 | 98 | 107 |
| Paraffin content (% $C_p$) | — | 94.1 | 69.8 | 74.7 | 66.8 | 73 |

Based on the values of the kinematic viscosity at 40° C. in Table 1, the mineral base oil (1) of Production Example 1 conforms to a viscosity grade VG46 as defined in ISO 3448, and the mineral base oil of Production Example 2 conforms to VG100.

Examples 1 to 6 and Comparative Examples 1 to 6 (Preparation of Vacuum Pump) Oils Base oils and additives of types and blending amounts described in Tables 2 and 3 were blended and thoroughly stirred to prepare vacuum pump oils, respectively.

In preparation of the vacuum pump oil, the details of the base oil and the additive used are as follows.

<Base Oil>

Mineral base oil (1): mineral base oil obtained in Production Example 1, Δ|DT|=4.3° C./vol %.

Mineral base oil (2): mineral base oil obtained in Production Example 2, Δ|Dt|=6.3° C./vol %.

Mineral base oil (3): mineral base oil obtained in Production Example 3, Δ|Dt|=7.0° C./vol %.

Mineral base oil (4): mineral base oil obtained in Production Example 4, Δ|Dt|=7.3° C./vol %.

Mineral base oil (5): mineral base oil obtained in Production Example 5, Δ|Dt|=12.3° C./vol %.

PAO: poly-α-olefin, kinematic viscosity at 40° C.=30.50 $mm^2/s$, viscosity index=135, density at 15° C.=0.8330 $g/cm^3$.

<Various Additives>

Phenol-based Antioxidant (1): benzenepropanoic acid 3,5-bis(1,1-dimethylethyl)-4-hydroxyalkyl ester.

Phenol-based Antioxidant (2): 4,4'-methylenebis(2,6-di-t-butylphenonol).

Amine-based antioxidant (1): 4,4'-dioctyldiphenylamine.

Amine-based antioxidant (2): p-t-octylphenyl-1-naphthylamine.

Metal Deactivator: 2-(2-hydroxy-4-methylphenyl) benzotriazole.

The prepared vacuum pump oil was subjected to the following measurements. The results are shown in Tables 2 and 3.

(1) RPVOT Value and Acid Value Increase Amount

The time (RPVOT value) for a pressure to drop 175 kPa from a maximum pressure was measured at a test temperature of 150° C. and an initial pressure of 620 kPa in conformity with a rotary pressure vessel oxidation test (RPVOT) of JIS K2514-3. It is said that the longer the time, the more excellent the oxidation stability of the vacuum pump oil.

The acid values of a sample oil before and after the rotary pressure vessel oxidation test were measured in conformity with JIS K2501 (indicator method), and a difference thereof was taken as an "acid value increase amount".

(2) Water Separation Property

A water separation property test at a temperature of 54° C. was performed in conformity with JIS K2520. In Table 1, "volume oil layer (ml)", "aqueous layer volume (ml)", "emulsified layer volume (ml)", and "elapsed time (minute)" were listed in this order. The smaller the "emulsified layer volume" and the shorter the "elapsed time", the better the water separation property.

(3) Ultimate Vacuum Pressure

The ultimate vacuum pressure was measured in conformity with JIS B8316-2. Specifically, after the vacuum pump oil was filled in a compressor portion of an oil rotary vacuum pump, the vacuum pump was started, and a vacuum pressure at a suction port after 1 hour was taken as the "ultimate vacuum pressure". It is said that the smaller the value of the ultimate vacuum pressure, the more the excellent vacuum characteristics.

TABLE 2

| | | | | Example | | | | | |
|---|---|---|---|---|---|---|---|---|---|
| | | | | 1 | 2 | 3 | 4 | 5 | 6 |
| Composition | Base oil | Mineral base oil (1) Δ\|Dt\| = 4.3° C./vol % | % by mass | 99.69 | — | 40.00 | 75.00 | 75.00 | 75.00 |
| | | Mineral base oil (2) Δ\|Dt\| = 6.3° C./vol % | % by mass | — | 99.69 | 59.69 | — | — | — |
| | | Mineral base oil (3) Δ\|Dt\| = 7.0° C./vol % | % by mass | — | — | — | — | — | — |
| | | Mineral base oil (4) Δ\|Dt\| = 7.3° C./vol % | % by mass | — | — | — | — | — | — |
| | | Mineral base oil (5) Δ\|Dt\| = 12.3° C./vol % | % by mass | — | — | — | 24.69 | 24.50 | 24.80 |
| | | PAO | % by mass | — | — | — | — | — | — |
| | Additive | Phenol-based antioxidant (1) | % by mass | 0.20 | 0.20 | 0.20 | 0.20 | — | — |
| | | Phenol-based antioxidant (2) | % by mass | — | — | — | — | 0.20 | — |
| | | Amine-based antioxidant (1) | % by mass | 0.10 | 0.10 | 0.10 | 0.10 | 0.30 | 0.10 |
| | | Amine-based antioxidant (2) | % by mass | — | — | — | — | — | 0.10 |
| | | Metal deactivator | % by mass | 0.01 | 0.01 | 0.01 | 0.01 | — | — |
| | — | Total | % by mass | 100.00 | 100.00 | 100.00 | 100.00 | 100.00 | 100.00 |
| Properties of vacuum pump oil | | Kinematic viscosity at 40° C. | $mm^2/s$ | 44.17 | 99.27 | 68.05 | 68.22 | 68.44 | 68.11 |
| | | Viscosity index | — | 143 | 102 | 116 | 132 | 132 | 132 |
| Various characteristics of vacuum pump oil | | RPVOT value | minute | 240 | 265 | 248 | 259 | 298 | 388 |
| | | Acid value increase amount | mgKOH/g | 0.00 | 0.01 | 0.00 | 0.00 | 0.01 | 0.00 |
| | | Water separation property | — | 40-40-0(5) | 39-38-3(10) | 41-39-0(5) | 40-40-0(5) | 41-39-0(5) | 40-40-0(5) |
| | | Ultimate vacuum pressure | Pa | 0.4 or less | 0.4 or less | 0.4 or less | 0.4 or less | 0.4 or less | 0.4 or less |

TABLE 3

| | | | | Comparative Example | | | | | |
|---|---|---|---|---|---|---|---|---|---|
| | | | | 1 | 2 | 3 | 4 | 5 | 6 |
| Composition | Base oil | Mineral base oil (1) $\Delta\lvert Dt\rvert$ = 4.3° C./vol % | % by mass | — | — | — | — | — | — |
| | | Mineral base oil (2) $\Delta\lvert Dt\rvert$ = 6.3° C./vol % | % by mass | — | — | — | — | — | — |
| | | Mineral base oil (3) $\Delta\lvert Dt\rvert$ = 7.0° C./vol % | % by mass | 99.69 | 58.80 | — | — | — | — |
| | | Mineral base oil (4) $\Delta\lvert Dt\rvert$ = 7.3° C./vol % | % by mass | — | 41.00 | 99.69 | 90.00 | 90.00 | — |
| | | Mineral base oil (5) $\Delta\lvert Dt\rvert$ = 12.3° C./vol % | % by mass | — | — | — | — | — | 99.69 |
| | | PAO | % by mass | — | — | — | 9.50 | 9.80 | — |
| | Additive | Phenol-based antioxidant (1) | % by mass | 0.20 | — | 0.20 | — | — | 0.20 |
| | | Phenol-based antioxidant (2) | % by mass | — | — | — | 0.20 | — | — |
| | | Amine-based antioxidant (1) | % by mass | 0.10 | 0.10 | 0.10 | 0.30 | 0.10 | 0.10 |
| | | Amine-based antioxidant (2) | % by mass | — | 0.10 | — | — | 0.10 | — |
| | | Metal deactivator | % by mass | 0.01 | — | 0.01 | — | — | 0.01 |
| | — | Total | % by mass | 100.00 | 100.00 | 100.00 | 100.00 | 100.00 | 100.00 |
| Properties of vacuum pump oil | | Kinematic viscosity at 40° C. | $mm^2/s$ | 34.96 | 45.33 | 75.23 | 67.15 | 68.73 | 408.8 |
| | | Viscosity index | — | 118 | 110 | 98 | 104 | 102 | 107 |
| Various characteristics of vacuum pump oil | | RPVOT value | minute | 295 | 830 | 264 | 281 | 378 | 278 |
| | | Acid value increase amount | mgKOH/g | 0.00 | 0.01 | 0.01 | 0.01 | 0.01 | 0.01 |
| | | Water separation property | — | 39-38-3(10) | 40-38-2(5) | 39-38-3(20) | 39-38-3(15) | 39-38-3(10) | — |
| | | Ultimate vacuum pressure | Pa | 0.7 | 0.7 | 0.8 | 0.8 | 0.7 | 0.4 or less |

Table 2 reveals that the vacuum pump oils prepared in Examples 1 to 6 are excellent in vacuum characteristics since the ultimate vacuum pressure is low, and the vacuum pump oils prepared in Examples 1 to 6 are also good in oxidation stability and water separation property.

The vacuum pump oil according to Example 1 conforms to a viscosity grade VG46 as defined in ISO 3448, the vacuum pump oil according to Example 2 conforms to VG100, and the vacuum pump oils according to Examples 3 to 6 conform to VG68.

On the other hand, the vacuum pump oils prepared in Comparative Examples 1 to 5 all have a high ultimate vacuum pressure and result in poor vacuum characteristics.

In addition, the vacuum pump oil prepared in Comparative Example 6 has a very high kinematic viscosity at 40° C. and does not conform to VG22 to VG100. Therefore, the water separation property was not measured.

The invention claimed is:

1. A vacuum pump oil, consisting of:

a base oil (I), which is a mineral base oil;

an antioxidant (I), which is an amine-based antioxidant;

optionally a base oil (II);

optionally an antioxidant (II), which optionally comprises a phenol-based antioxidant;

optionally a metal deactivator; and optionally an antifoaming agent, wherein the base oil (I) exhibits a distillation curve with a temperature gradient $\Delta\lvert Dt\rvert$ of distillation temperature between two points of 2.0 vol % and 5.0 vol % of distillation amount being 6.8° C./vol % or less, a distillation temperature at which the distillation amount is 2.0 vol % being 405° C. to 510° C., and a distillation temperature at which the distillation amount is 5.0 vol % being from 425° C. to 550° C., and the base oil (I) has a kinematic viscosity at 40° C. of 28.8 $mm^2/s$ to 110.0 $mm^2/s$.

2. The vacuum pump oil of claim 1, wherein the base oil (I) is a paraffinic mineral oil, and/or the vacuum pump oil comprises the base oil (II), and the base oil (II) comprises a paraffinic mineral oil.

3. The vacuum pump oil of claim 1, wherein the vacuum pump oil comprises the base oil (II), and the base oil (II) comprises a mineral oil (II-1) having a viscosity grade not lower than a viscosity grade of VG220 as defined in ISO 3448.

4. The vacuum pump oil of claim 1, which has an ultimate vacuum pressure of 0.6 Pa or less as measured in conformity with JIS B8316-2.

5. The vacuum pump oil of claim 1, which conforms to a viscosity grade VG46 as defined in ISO 3448.

6. The vacuum pump oil of claim 1, which conforms to a viscosity grade VG68 as defined in ISO 3448.

7. A method of using a vacuum pump oil, the method comprising supplying the vacuum pump oil to a vacuum pump, wherein the vacuum pump oil consists of:

a base oil (I), which is a mineral base oil;

an antioxidant (I), which is an amine-based antioxidant;

optionally a base oil (II);

optionally an antioxidant (II), which optionally comprises a phenol-based antioxidant;

optionally a metal deactivator; and optionally an antifoaming agent, wherein the base oil (I) exhibits a distillation curve with a temperature gradient $\Delta\lvert Dt\rvert$ of distillation temperature between two points of 2.0 vol % and 5.0 vol % of distillation amount being 6.8° C./vol % or less, a distillation temperature at which the distillation amount is 2.0 vol % being 405° C. to 510° C., and a distillation temperature at which the distillation amount is 5.0 vol % being from 425° C. to 550° C., and the base oil (I) has a kinematic viscosity at 40° C. of 28.8 $mm^2/s$ to 110.0 $mm^2/s$.

8. A vacuum pump, comprising a vacuum pump oil consisting of:

a base oil (I), which is a mineral base oil;

an antioxidant (I), which is an amine-based antioxidant;

optionally a base oil (II);

optionally an antioxidant (II), which optionally comprises a phenol-based antioxidant;

optionally a metal deactivator; and optionally an antifoaming agent, wherein the base oil (I) exhibits a distillation curve with a temperature gradient Δ|Dt| of distillation temperature between two points of 2.0 vol % and 5.0 vol % of distillation amount being 6.8° C. vol % or less, a distillation temperature at which the distillation amount is 2.0 vol % being 405° C. to 510° C., and a distillation temperature at which the distillation amount is 5.0 vol % being from 425° C. to 550° C., and the base oil (I) has a kinematic viscosity at 40° C. of 28.8 $mm^2/s$ to 110.0 $mm^2/s$.

9. A method of producing a semiconductor, solar cell, aircraft, automobile, or food, the method comprising operating the vacuum pump of claim 8.

10. The vacuum pump oil of claim 1, wherein the base oil (I) has a paraffin content (% $C_P$) of 50 or more.

11. The vacuum pump oil of claim 1, wherein the base oil (I) exhibits a distillation curve with a distillation temperature at which the distillation amount is 5.0 vol % is from 450° C. to 550° C.

12. The vacuum pump oil of claim 1, wherein a content of the base oil (I) is 70% by mass or more based on a total amount (100% by mass) of the vacuum pump oil.

13. The vacuum pump oil of claim 1, which has a rotary pressure vessel oxidation test (RPVOT) value of 200 minutes or longer as measured in conformity with JIS K2514-3.

14. The method of claim 7, wherein the base oil (I) is a paraffinic mineral oil, and/or the vacuum pump oil comprises the base oil (II), and the base oil (II) comprises a paraffinic mineral oil.

15. The method of claim 7, wherein the vacuum pump oil comprises the base oil (II), and the base oil (II) comprises a mineral oil (II-1) having a viscosity grade not lower than a viscosity grade of VG220 as defined in ISO 3448.

16. The method of claim 7, wherein the vacuum pump oil has an ultimate vacuum pressure of 0.6 Pa or less as measured in conformity with JIS B8316-2.

17. The vacuum pump of claim 8, wherein the base oil (I) is a paraffinic mineral oil, and/or the vacuum pump oil comprises the base oil (II), and the base oil (II) comprises a paraffinic mineral oil.

18. The vacuum pump of claim 8, wherein the vacuum pump oil comprises the base oil (II), and the base oil (II) comprises a mineral oil (II-1) having a viscosity grade not lower than a viscosity grade of VG220 as defined in ISO 3448.

19. The vacuum pump of claim 8, wherein the vacuum pump oil has an ultimate vacuum pressure of 0.6 Pa or less as measured in conformity with JIS B8316-2.

* * * * *